United States Patent [19]

Serizawa et al.

[11] Patent Number: 4,915,554

[45] Date of Patent: Apr. 10, 1990

[54] HERMETIC ROTARY COMPRESSOR WITH BALANCING WEIGHTS

[75] Inventors: Yukio Serizawa; Kazuo Ikeda; Hiroaki Hata, all of Tochigi; Shin Ishihara, Kasukabe; Motohiro Shiga, Hitachi, all of Japan

[73] Assignee: Hitachi, Ltd., Tokyo, Japan

[21] Appl. No.: 258,462

[22] Filed: Oct. 17, 1988

[30] Foreign Application Priority Data

Oct. 19, 1987 [JP] Japan ..... 62-261588

[51] Int. Cl.[4] ..... F04C 18/356; F04C 29/02

[52] U.S. Cl. ..... 418/94; 418/96; 418/151; 418/181

[58] Field of Search ..... 418/63, 88, 94, 96, 418/151, 181; 417/312, 410

[56] References Cited

U.S. PATENT DOCUMENTS 4,710,111 12/1987 Kubo ..... 418/151

FOREIGN PATENT DOCUMENTS 59-165886 9/1984 Japan ..... 418/151
61-45079 10/1986 Japan .
62-87690 4/1987 Japan ..... 418/151
62-284983 12/1987 Japan ..... 418/151

*Primary Examiner*—John J. Vrablik
*Attorney, Agent, or Firm*—Antonelli, Terry & Wands

[57] ABSTRACT

A hermetic rotary compressor has a motor unit composed of a stator and a rotor which are arranged in an upper portion of a hermetic housing, an oil-lubricated compressor unit arranged in a lower portion of the hermetic housing, a crank shaft which interconnects said motor unit and said compressor unit, a discharging silencer which is formed by a lower bearing of the compressor unit positioned around the lower end of the crank shaft and a cover of the lower bearing. The hermetic rotary compressor further has a lower balancing weight mounted around a lower shaft end portion of the crank shaft which extends to a position below the discharging silencer and a weight cup surrounding the lower balancing weight. In this hermetic rotary compressor, the lower balancing weight is not disposed within the discharging silencer. Hence, even is the gas-liquid mixture of refrigerant is discharged from the discharging valve into the silencer chamber in the start-up or during liquid-back operation of the compressor, there is no risk that the lower balancing weight undesirably stirs such a fluid.

10 Claims, 5 Drawing Sheets

HERMETIC ROTARY COMPRESSOR WITH BALANCING WEIGHTS

BACKGROUND OF THE INVENTION

The present invention relates to a hermetic rotary compressor, and more particularly to a compressor which is suitable for high-speed operation.

As shown in FIG. 5, a conventional hermetic rotary compressor includes a motor unit 3 composed of a rotor 1 which normally rotates in the direction of an arrow A and a stator 2 is arranged in an upper portion of a hermetic housing 10. In a lower portion of the hermetic housing 10 is disposed a compressor unit 8 comprising a cylinder 4, a roller 5, a main bearing 6, a lower bearing 7 and a partition board (not shown). The motor unit 3 and the compressor unit 8 are connected by a crank shaft 9. Lubricating oil 11 is stored at the bottom portion of the hermetic housing 10, and this oil lubricates each sliding portion of the compressor unit 8 via an oil supplying path (not shown) formed inside the compressor unit 8. The roller 5 is fitted to a crank portion 9*a* of the crank shaft 9 so as to freely rotate, and this roller 5 rotates eccentrically within the cylinder 4 so that a refrigerant is sucked and compressed. The compressed refrigerant is passed through a valve 12 and then discharged out to a discharging silencer 14 formed by a valve cover 13 and the lower bearing 7. The compressed refrigerant is then passed through a discharging path (not shown) and flows out to a space 10*a* within the hermetic housing 10. In operation of this compressor, centrifugal force is generated to act on the abovementioned crank portion 9*a* and roller 5, so that there is a possibility that the crank shaft 9 is deflected during rotation at the portion carrying the crank portion 9*a* and the roller 5. To obviate this problem, first and second rotor balance weights 15 and 16 are normally provided on upper and lower edges of end ring of the rotor 1, and the centrifugal force acting on the crank portion 9*a* and roller 5 is cancelled by the centrifugal force generated by these first and second rotor balance weights so as to balance the crank shaft 9. Theoretically, the conditions for the balance of the crankshaft are expressed by the following formulae.

$$Fo+Fb-Fa=O, \text{ and}$$

$$Fa \cdot La-Fb \cdot Lb=O.$$

From there formulae, the following formulae are derived.

$$Fa=Fo \cdot Lb/(Lb-La), \text{ and}$$

$$Fb=Fo \cdot La/(Lb-La),$$

where Fo represents the centrifugal force acting on the crank portion 9*a* and roller 5, Fa represents the centrifugal force on the rotor balance weight 16, and Fb represents the centrifugal force on the rotor balance weight 15. The distance between the crank portion 9*a* and the rotor balance weight 16, and the distance between the crank portion 9*a* and the rotor balance weight 15 are represented by La and Lb, respectively. More specifically, since each of the denonimators of the centrifugal forces Fa and Fb is expressed by difference form, i.e., (Lb−La), there is a tendency that the centrifugal forces Fa and Fb increase, so that the masses of the rotor balance weights 15 and 16 must be increased. Consequently, load applied to the crank shaft 9 is increased, so that a problem is encountered in that it is difficult to efficiently utilize the electric energy given to the electric motor unit 3.

In order to solve this problem of the conventional compressor, a compressor has been proposed in Japanese Examined Patent Publication No. 61-45079 is proposed and is shown in FIG. 6.

In the compressor shown in FIG. 6, in order to cancel centrifugal force Fo1, a lower balance weight 17 is attached to the end 9*b* of the crank shaft 9 adjacent to a lower bearing side edge portion 9*b* of the crank shaft 9, while a rotor balance weight 15 is provided on the upper end portion of the rotor 1. The conditions for the balance are theoretically expressed as follows.

$$Fa1+Fb1-Fo1=O, \text{ and}$$

$$Fa1 \cdot La1-Fb1 \cdot Lb1=O.$$

Therefore, the following formulae can be obtained.

$$Fa1=Fo1 \cdot Lb1/(Lb1+La1), \text{ and}$$

$$Fb1=Fo1 \cdot La1/(Lb1+La1),$$

where, Fo1 represents the centrifugal force acting on the crank portion 9*a* and roller 5, Fa1 represents the centrifugal force of the lower balance weight 17, and Fb1 represents the centrifugal force of the rotor balance weight 15. The distance between the crank portion 9*a* and lower balance weight 17, and the distance between the crank portion 9*a* and rotor balance weight 15 are represented by La, and Lb, respectively. More specifically, each of the denominators of the centrifugal forces Fa1 and Fb1 is expressed in a sum form, i.e., (Lb1+La1), unlike the construction of FIG. 5 which employs the difference form (Lb−La). Therefore, compared to the construction of FIG. 5, the values of centrifugal forces Fa1 and Fb1 are remarkably reduced. It is therefore possible to decrease the masses of lower balance weight 17 and rotor balance weight 15, so that. the load of bearing can be remarkably reduced.

However, since the length of crank shaft 9 between the compressor unit 8 and the motor unit 3 is considerably large, there is a possibility in that large deflection of the crank shaft 9 is generated at the side of rotor balance weight 15 as the speed of rotation in the direction A becomes higher.

In addition, in the conventional arrangement shown in FIG. 6, the lower balance weight 17 is surrounded by a cover body 18 which plays both a role of a valve cover and a role of a balancer cover so as to prevent the lower balance weight 17 from unnecessarily stirring the lubricating oil 11. Since the cover body 18 acts both as the valve cover and balancer cover, the interior of the cover body 18 is filled with the discharged gas so as to enable the lower balance weight 17 to rotate without stirring the lubricating oil.

The cover body 18 capable of functioning both as the valve cover and balancer cover in the abovementioned proposed prior art, however, poses the following problems when this prior art is actually embodied in the compressor.

More specifically, since the lower balance weight 17 is arranged within a chamber 19 constituting the discharging silencer, when the liquid refrigerant or the gas-liquid mixture of the refrigerant is discharged from the valve 12 into the silencer chamber 19 particularly in the start-up or in so-called liquid back operation, the lower balance weight 17 must stir such fluid so that vigorous foaming phenomenon is caused by the mixing effect. Then, the foam or bubbles of refrigerant fills up the space 10*a* in the hermetic housing 10, so that there is a possibility that the rotation load is abnormally increased and the input current to the motor 3 is correspondingly increased, or an excessive amount of lubricating oil is discharged out of an discharge port 10*d* of the hermetic housing 10 so that the oil surface level is lowered.

As stated before, the cover body 18 functions both as the valve cover and as the balancer cover, while the crank shaft 9 shown in FIG. 6 is a movable element. Hence, it is necessary to provide a minimum gap between the lower end portion 9*b* of crank shaft 9 and a ring portion 18*a* of the cover body 18 to which this lower shaft end portion 9*b* is fitted, in order to enable assembly of the compressor.

Consequently, there is fear that the noise leaks through the gap to result in the increase of the noise from the compressor. It would be possible to eliminate the gap by inserting a seal member such as packing and 0-ring into the gap. In such a construction, the crank shaft and seal member are frictioned by each other with the results being that the rotation load increases and durability of the seal member is impaired to disable the seal member to stand a long use.

An object of the present invention is to provide a compressor in which the problem encountered when the balance weight is provided at lower shaft end portion of the crank shaft is reduced.

To these ends, according to one aspect of the present invention, there is provided a hermetic rotary compressor having a motor unit composed of a stator and a rotor which are arranged in an upper portion of a hermetic housing, an oil-lubricated compressor unit arranged in a lower portion of the hermetic housing, a crank shaft connecting the motor unit and the compressor unit, and a discharge silencer formed by a lower bearing of the compressor unit supporting a lower end portion of the crank shaft and a cover of the lower bearing, wherein the hermetic rotary compressor further comprises a lower balance weight mounted on a lower shaft end portion of the crank shaft which extends to a position below the discharge silencer and two rotor balance weights provided on both end portions of the rotor.

In this hermetic rotary compressor, the lower balance weight provided in addition to the two rotor balance weights provides a three-points balancing construction for the compressor, so that it is possible to reduce the amount of deflection of the crank shaft.

In a preferred embodiment of the present invention, the compressor further comprises a weight cup surrounding the lower balance weight.

In another aspect of the present invention, there is provided a hermetic rotary compressor having a motor unit composed of a stator and a rotor which are arranged in an upper portion of a hermetic housing, an oil-lubricated compressor unit arranged at a lower portion of the hermetic housing, a crank shaft connecting the motor unit and the compressor unit, and a discharge silencer formed by a lower bearing of the compressor unit positioned at a lower end portion of the crank shaft and a cover of the lower bearing, wherein the hermetic rotary compressor further comprises a lower balance weight mounted on a lower shaft end portion of the crank shaft which extends to a position below the discharge silencer and a weight cup surrounding the lower balance weight.

According to the another aspect of the present invention, there is no lower balance weight within the discharge silencer, so that there is no risk of stirring of liquid even when the liquid refrigerant or gas-liquid refrigerant mixture is discharged from the discharging valve of the compressor unit into the silencer in the start-up or liquid-back operation of the compressor.

According to the present invention, the weight cup is preferably provided with an inlet opening which permits the lubricating oil to flow into the weight cup and an outlet opening which permits the lubricating oil to flow out of the weight cup during the operation of the compressor.

It is also preferred that the weight cup has a hollow cylindrical shape having a bottom portion, with the inlet opening formed in the bottom portion of the cylinder, while the outlet opening is formed in side wall portion of the cylinder.

Further, according to the present invention, preferably, a lubricating oil passage is formed in the compressor unit such that the lubricating oil passing through the oil-lubricated compressor unit is relieved from the lower shaft end portion of the crank shaft to a region which is in the vicinity of upper face of the lower balance weight within the weight cup.

BRIEF DESCRIPTION OF THE DRAWINGS

Other objects, features and advantages of the invention will become more apparent upon reference to the succeeding detailed description thereof and to the drawings illustrating the preferred embodiment, wherein.

DETAILED DESCRIPTION

Figure 1:
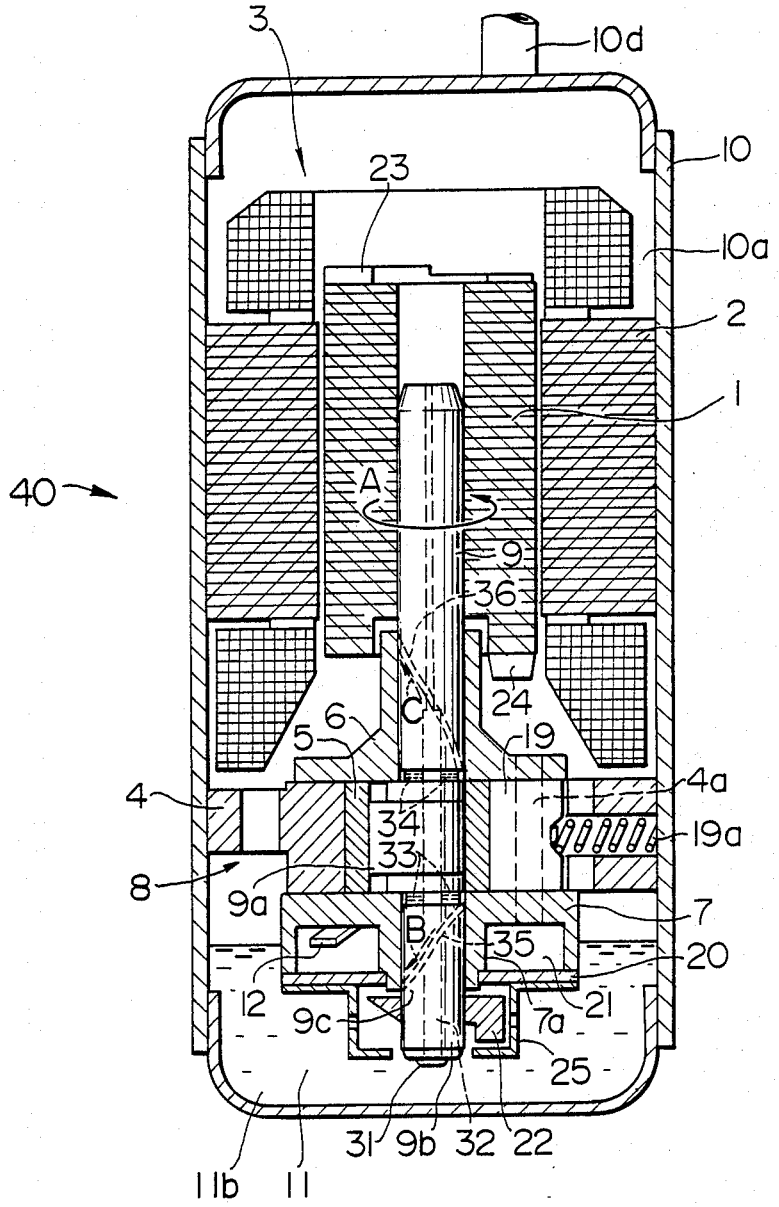
FIG. 1 is a vertical sectional view of a hermetic rotary compressor according to the present invention.
Figure 2:
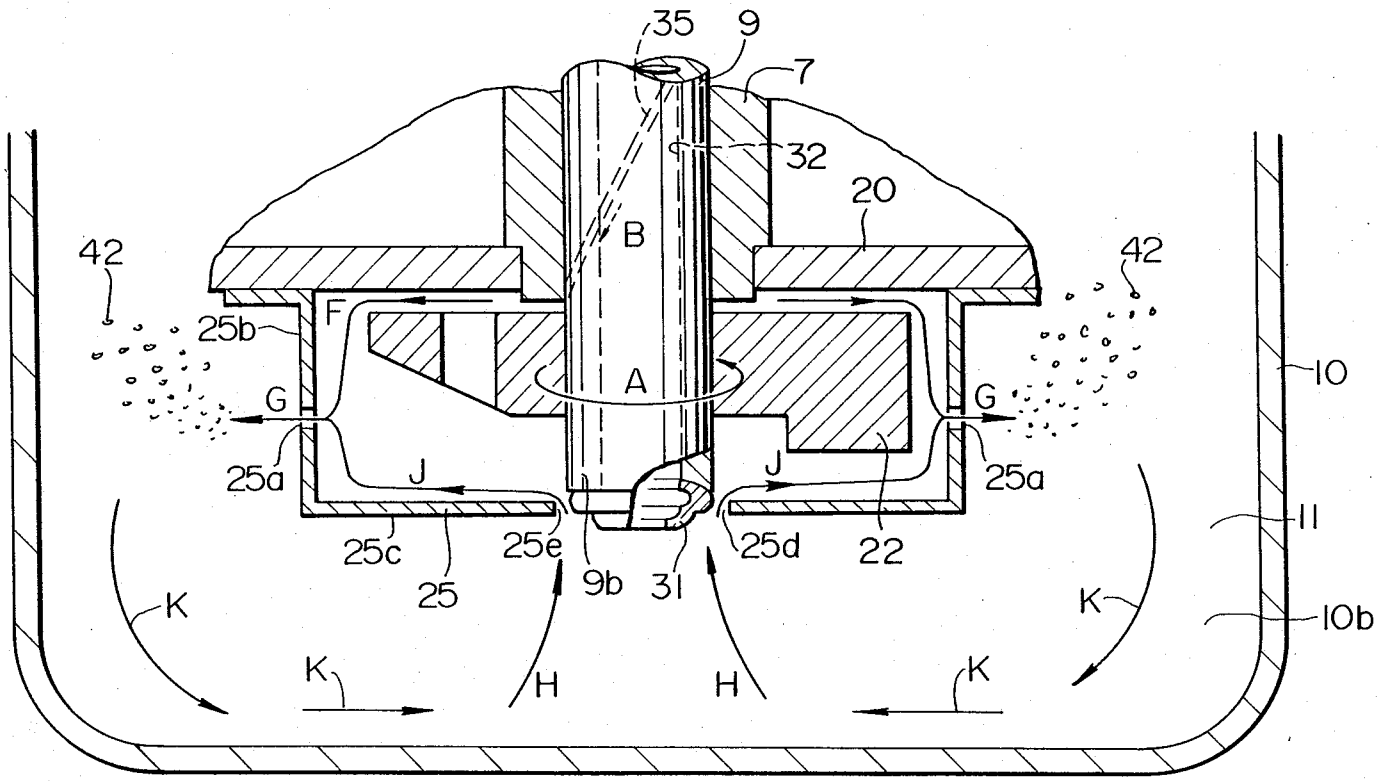
FIG. 2 is a enlarged sectional view showing a portion of a lower balance weight and a weight cup in the compressor shown in FIG. 1.

Referring to FIGS. 1 and 2, according to these figures, an electric motor unit 3 composed of a rotor 1 and a stator 2 is arranged in an upper portion of the space 10*a* within the hermetic housing 10. A compressor unit 8 is provided at the lower portion of the space 10*a*, with the compressor unit 8 comprising a cylinder 4, a roller 5, a vane 19 which is pressed against the roller 5 by a spring 19*a*, a main bearing 6, and a lower bearing 7. The motor unit 3 and the compressor unit 8 are connected together by a crank shaft 9. The roller 5 is fitted to a crank portion 9*a* of the crank shaft 9 so as to freely slide, and the roller 5 eccentrically rotates in the direction of an arrow A within the cylinder 4 so as to suck and compress a refrigerant. The compressed refrigerant gas is passed through a discharge valve 12, and thereafter this gas is relieved into the space 10*a* of the hermetic housing 10 via a discharging silencer chamber 21 formed by the lower bearing 7 and a cover member 20 which covers an annular recess 7*a* of the lower bearing 7 and also via a discharging path 4*a* within the cylinder 4.

Lubricating oil 11 is charged in a bath or reservoir 11*b* constituted by the bottom portion of the hermetic housing 10. This lubricating oil 11 within the bath 11*b* is fed upward from a lubricating oil supply piece 31 attached to the lower shaft end of the crank shaft 9 through a helical passage-forming member (not shown) fixed in a hole 32 in the crank shaft 9, and then this lubricating oil 11 reaches the peripheral face of the crank shaft 9 via transverse holes 33 and 34. Part of this lubricating oil 11 flows as indicated by arrows B and C through spiral grooves 35 and 36 which are formed respectively on inner peripheral surface of the lower bearing 7 leading to the lower end portion of the lower bearing 7 and on the inner peripheral surface of the main bearing 6 leading to the upper end portion of the main bearing 6.

A lower balance weight 22 is mounted on the end portion 9*b* of the lower shaft portion 9*c* of the crank shaft 9 which extends to a position below the discharging silencer 21. On the other hand, rotor balance weights 23 and 24 are provided on the upper and lower end portions of the rotor 1, so as to balance with the centrifugal forces due to the roller 5 and crank portion 9*a* and the centrifugal force due to the lower balance weight 22. Thus, the lower balance weight 22 and two rotor balance weights 23 and 24 provide three-points balancing structure. In addition, the weight cup 25 is mounted at the lower face of the cover member 20 such that this cup 25 surrounds the lower balance weight 22.

Moreover, as shown in FIG. 2, a plurality of holes 25*a* are provided in the side wall or peripheral wall 25*b* of the cylindrical weight cup 25. A hole 25*e* (whose diameter is 18.8 mm, for example) is further formed at the bottom wall 25*c* of the cylinder of weight cup 25 so as to form a gap 25*d* (whose width in radial direction is 1.4 mm, for example) which permits the lower shaft end portion 9*b* (whose outer diameter is 16 mm, for example) of the crank shaft 9 to rotate in the direction of the arrow A.

Figure 3A:
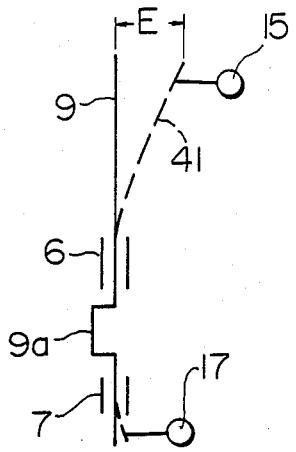
FIGS. 3A and 3B are illustrations showing, respectively, the deflection states of crank shafts in a two-position balancing construction and in multi-position balancing construction.
Figure 3B:
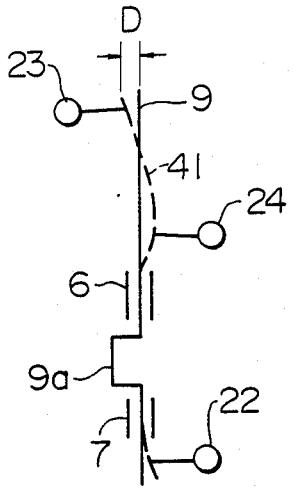
Figure 5:
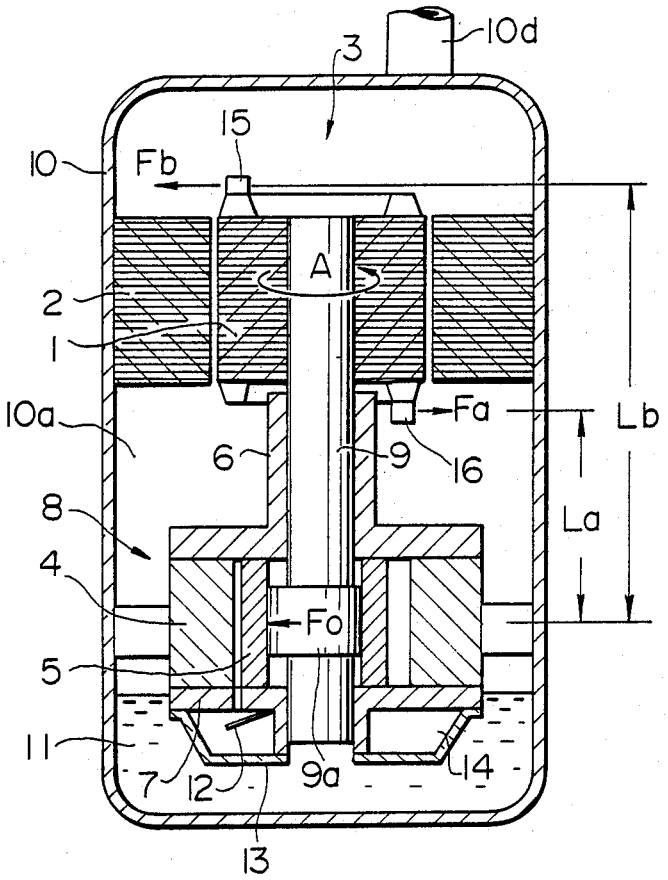
FIG. 5 PRIOR ART
FIGS. 5 and 6 are vertical sectional views showing the conventional hermetic rotary compressors.
Figure 6:
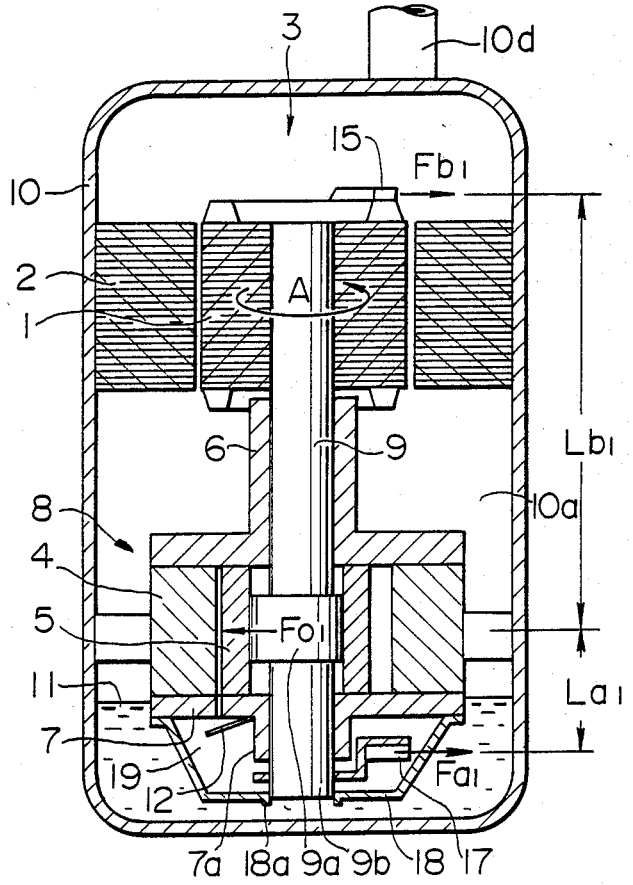
FIG. 6 PRIOR ART

The hermetic rotary compressor 40 according to an embodiment of the present invention, which is constituted as described above, adopts the multi-points balancing structure in which three balance weights, i.e., the lower balance weight 22 and two rotor balance weights 23 and 24, produce centrifugal forces which balance the centrifugal force acting on the crank portion 9*a* and roller 5. Hence, when the crank shaft 9 which is supported by the main bearing 6 and lower bearing 7 is rotated in the direction of the arrow A under the operation of the motor unit 3, the direction of deflection caused by the balance weight 24 can be set opposite to that caused by the balance weight 23 as shown by dashed line 41 in FIG. 3B, so that the deflection or oscillation amplitude D of the crank shaft 9 in the radial direction can be decreased, compared with an oscillation amplitude E in case of the two-points balancing structure in FIG. 6 which is diagrammatically shown by FIG. 3A. More specifically, in case of the multi-points balancing structure, the deflection magnitude D of the crank shaft 9 is small, so that it is possible to increase the maximum allowable rotation speed, comparing to that of the two-points balancing structure. Meanwhile, from the viewpoint of the arrangement of balancing weights, unlike the case of FIG. 5 wherein the balancing weights 15, 16 are provided only at one side of the crank portion 9*a*, the balancing weights are provided on both ends (both upper and lower ends) of the crank 9*a* in case of the compressor 40, similar to the case of the compressor of FIG. 6. Thus, it is also possible to use balancing weights having relatively small masses.

In addition, since the lower balancing weight 22 is positioned outside the discharging silencer 21 in the compressor 40, the discharging silencer 21 is formed by the lower bearing 7 and cover member 20 both of which are stationary. Therefore, even if the liquid refrigerant or the gas-liquid mixture of the refrigerant is discharged from the discharging valve 12 of the compressor unit 8 into the silencer chamber 21 in the start-up or liquid-back operation of the compressor, there is no risk for the lower balancing weight 22 to stir such fluid. In addition, there is no need to provide the gap between the lower bearing 7 and cover member 20.

Further, in the present embodiment, as shown in FIG. 2, because the small holes 25*a* are provided in the side wall of the weight cup 25, the lubricating oil at the upper and lower sides of the lower balancing weight 22 can easily flow as shown by an arrow F due to the rotation of lower balancing weight 22 in the direction of the arrow A during the operation of the compressor 40, which facilitates the flow of the lubricating oil 11 in the direction of the arrow B along the spiral groove 35 formed on the inner peripheral surface of the lower bearing 7. The lubrication of the lower bearing 7 is thus improved. Moreover, since the flow rate of the lubricating oil 11 which is fed upward from the lubricating oil supply piece 31 via the hole 32 of the crank shaft 9 is increased in response to the increase in the rotation speed of the crank shaft 9, it is possible to enhance the cooling effect of the lubrication oil to prevent overheating of the compression mechanism 8 and the discharged gas, so that the reliability of the compressor 40 can be improved. In addition, as the hole 25*e* (whose diameter is 18.8 mm, for example) formed in the bottom wall 25*c* of the weight cup 25 provides the gap 25*d* (whose width in radial direction is 1.4 mm, for example) which permits the lower shaft end portion 9*b* (whose outer diameter is 16 mm, for example) of the crank shaft 9 to rotate in the direction of the arrow A, the lubricating oil 11 from the bath 11*b* can flow in the direction of the arrow H through the gap 25*d* and then flow in the direction of the arrow J toward the hole 25*a* such that the flow of the lubricating oil 11 from the small holes 25*a* in the radially outward direction of the arrow G is promoted. Therefore, the circulating flow which leads from the small hole 25*a* to the gap 25*d* as indicated by the arrow K is formed within the bath 11*b* outside the weight cup 25. Since this lubricating oil flowing from the gap 25*d* into the weight cup 25 has relatively low temperature, this lubricating oil can efficiently cool the compressor unit 8 and the discharged gas from the compressor unit 8 through the weight cup 25 etc.

In addition, since the lubricating oil 11 in which the refrigerant is dissolved is rapidly jetted or spouted out of the small hole 25*a* in the direction of the arrow G, a part of the refrigerant which has been dissolved in the lubricating oil 11 is vaporized to become gas under the impact due to the spouting, so that many small bubbles 42 are formed in the bath 11*b*. These tiny bubbles 42 serve to prevent the sound from transmitting via the lubricating oil 11 in the bath 11*b*, so that it is possible to reduce the noise level at the outside of the compressor 40.

Figure 4:
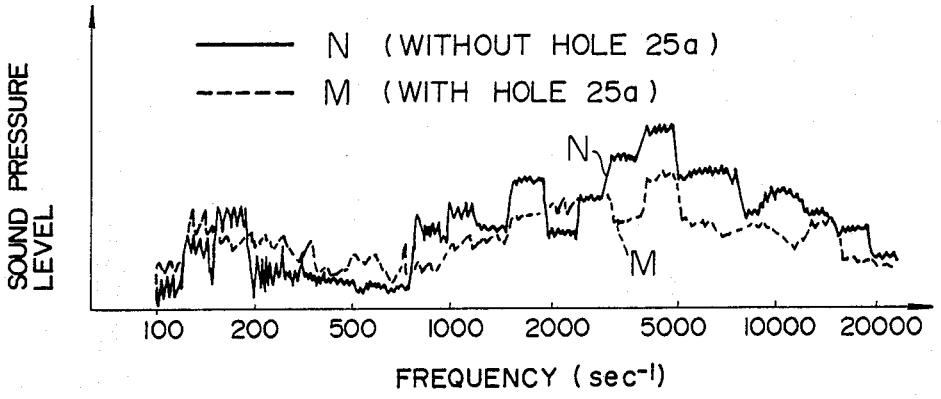
FIG. 4 is a graph showing the results of measurement of frequency dependency of sound pressure level of the noise generated from the compressor in the case where small holes are formed in the side wall of the weight cup and in the case where such holes are omitted.

FIG. 4 shows the result of measurement of noise level M generated from the compressor 40 having the small holes 25a and result of measurement of noise level N generated from the compressor having a similar structure 40 but having no such small hole 25a. It will be seen from FIG. 4 indicative of the sound pressure levels in relation to frequencies that the noise level M is equivalent to or lower than the noise level N over the substantially entire frequency range. Particularly, the silencing effect due to the small bubbles 42 is remarkable in the frequency range of 3,000 to 10,000 $sec^{-1}$.

The small holes 25a are provided along the peripheral wall 25b of the weight cup 25 at a constant angular interval. This, however, is not essential and the small holes 25a may be provided in irregular pitch.

It is also possible to arrange these holes in a plurality of stages which are spaced in vertical direction.

What is claimed is:

1. A hermetic rotary compressor having a motor unit composed of a stator and a rotor which are arranged in an upper portion of a hermetic housing, an oil-lubricated compressor unit arranged in a lower portion of said hermetic housing, a crank shaft connecting said motor unit and said compressor unit together, a discharging silencer formed by a lower bearing of said compressor unit positioned around a lower end portion of the crank shaft and a cover of said lower bearing, wherein said hermetic rotary compressor further comprises:

a lower balancing weight mounted on a lower shaft end portion of said crank shaft which extends to a position below said discharging silencer; and two rotor balancing weights provided on both end portions of said rotor.

2. A compressor according to claim 1, wherein the hermetic housing includes an oil sump in a bottom portion thereof, and said compressor further comprises a weight cup immersed in the oil sump and surrounding said lower balancing weight.

3. A hermetic rotary compressor comprising a motor means composed of a stator and a rotor which are arranged in an upper portion of a hermetic housing including an oil sump in a bottom portion thereof;

an oil lubricated compressor means arranged in a lower portion of said hermetic housing;

a crank shaft connecting said motor means and said compressor means together;

a discharging silencer formed by a lower bearing of said compressor means positioned around a lower end portion of the crank shaft and a cover of said lower bearing;

a lower balancing weight mounted on a lower shaft end portion of said crank shaft extending to a position below said discharging silencer;

two rotor balancing weights provided on both end portions of said rotor;

a weight cup immersed in the oil sump and surrounding said lower balancing weight, and wherein said weight cup has an inlet opening permitting lubricant oil to flow into said weight cup and an outlet opening permitting the lubricating oil to flow out of said weight cup during an operation of said compressor means.

4. A compressor according to claim 3, wherein said weight cup has a hollow cylindrical shape with a bottom portion, said inlet opening being formed at the bottom portion of said cylinder, said outlet opening being formed at a side wall portion of said cylinder.

5. A compressor according to claim 3, wherein a lubricating oil passage is formed through said oil-lubricated compressor means such that the lubricating oil passing through said compressor means is discharged from the lower shaft end portion of said crank shaft to a region in a vicinity of an upper face of said lower balancing weight within said weight cup.

6. A hermetic rotary compressor comprising:

a motor means including a stator and a rotor arranged in an upper portion of a hermetic housing having an oil sump in a bottom portion thereof;

an oil-lubricated compressor means arranged in a lower portion of said hermetic housing;

a crank shaft connecting said motor means and said compressor means together;

a lower bearing positioned around a lower end of said crank shaft and fixed at a lower face of said compressor means, said lower bearing having inner and outer peripheral wall portions extending downwardly from radially inner and outer end portions so as to define an annular space which opens downwardly;

a cover member fixed to ends of said inner and outer peripheral wall portions of the lower bearing so as to close the lower opening of said annular space of said lower bearing to thereby form a discharging silencer;

a lower balancing weight mounted on a lower shaft end portion of said crank shaft extending to a level lower than said cover member;

a weight cup immersed in the oil sump and surrounding said lower balancing weight, said weight cup having an annular mounting portion mounted on a lower face of said cover member, a peripheral wall portion extending downwardly from said annular mounting portion and having a plurality of small holes permitting lubricating oil to flow out, and an annular bottom wall portion extending radially inwardly from the end of said peripheral wall portion toward a lower end of the lower shaft end portion of the crank shaft and having an opening of a diameter larger than a diameter of the lower shaft end portion such that a gap is formed between said annular bottom wall portion and the lower end of the lower shaft end portion permitting the lubricating oil to flow inwardly, whereby said weight cup surrounds said lower balancing weight; and two rotor balancing weights provided at both end portions of said rotor.

7. A hermetic rotary compressor comprising:

a motor unit including a stator and a rotor arranged in an upper portion of a hermetic housing, an oil-lubricated compressor means arranged in a lower portion of the hermetic housing, a crank shaft interconnecting said motor means and said compressor means, a discharging silencer formed by a lower bearing of the compressor means positioned around a lower end portion of said crank shaft and a cover of said lower bearing, a lower balancing weight mounted on a lower shaft end portion of said crank shaft extending to a position below said discharging silencer; and a weight cup surrounding said lower balancing weight.

8. A hermetic rotary compressor comprising:

a motor means composed of a stator and a rotor arranged in an upper portion of a hermetic housing having an oil sump in a bottom portion thereof;

an oil-lubricated compressor means arranged in the lower portion of the hermetic housing;

crank shaft means interconnecting said motor means and said compressor means;

a discharging silencer formed by a lower bearing of the compressor means positioned around a lower end portion of said crank shaft and a cover of said lower bearing;

a lower balancing weight mounted on a lower shaft end portion of said crank shaft extending to a position below said discharging silencer; and a weight cup immersed in the oil sump and surrounding said lower balancing weight, wherein said weight cup has an inlet opening permitting lubricating oil to flow into said weight cup and an outlet opening permitting the lubricating oil to flow out of said weight cup during operation of said compressor means.

9. A compressor according to claim 8, wherein said weight cup has a hollow cylindrical shape with a bottom portion, said inlet opening being formed at the bottom portion of said cylinder, said outlet opening being formed at a side wall portion of said cylinder.

10. A compressor according to claim 8, wherein a lubricating oil passage is formed through said oil-lubricated compressor means such that the lubricating oil passing through said compressor means is discharged from the lower shaft end portion of said crank shaft to a region in a vicinity of an upper face of said lower balancing weight within said weight cup.

* * * * *